US012788145B2

(12) United States Patent
Yang

(10) Patent No.: US 12,788,145 B2
(45) Date of Patent: Nov. 10, 2026

(54) SUSPENSION CHAIR AND PLUG ASSEMBLY STRUCTURE

(71) Applicant: Zhejiang Hengfeng Top Leisure Co., Ltd., Zhejiang (CN)

(72) Inventor: Baoqing Yang, HangZhou (CN)

(73) Assignee: Zhejiang Hengfeng Top Leisure Co., Ltd., Zhejiang (CN)

( * ) Notice: Subject to any disclaimer, the term of this patent is extended or adjusted under 35 U.S.C. 154(b) by 90 days.

(21) Appl. No.: 18/925,423

(22) Filed: Oct. 24, 2024

(65) Prior Publication Data

US 2025/0134258 A1 May 1, 2025

(30) Foreign Application Priority Data

Oct. 27, 2023 (CN) ..... 202322908266.3

(51) Int. Cl.

| | |
|---|---|
| ***A45F 3/24*** | (2006.01) |
| ***A45F 3/26*** | (2006.01) |
| ***A47C 4/28*** | (2006.01) |
| ***A47C 4/30*** | (2006.01) |

(52) U.S. Cl.

CPC ..... *A47C 4/286* (2013.01); *A45F 3/24* (2013.01); *A45F 3/26* (2013.01); *A47C 4/30* (2013.01)

(58) Field of Classification Search

CPC ..... A45F 3/22; A45F 3/24; A45F 3/26

See application file for complete search history.

(56) References Cited

U.S. PATENT DOCUMENTS

| | | | | |
|---|---|---|---|---|
| 5,857,230 | A * | 1/1999 | Dowdy | B62J 11/22 5/118 |
| 6,665,896 | B1 * | 12/2003 | Tseng | A45F 3/24 5/120 |
| 6,711,764 | B1 * | 3/2004 | Mauze, Jr. | A45F 3/24 5/120 |
| 7,089,610 | B2 | 8/2006 | Zhong | |
| 7,996,935 | B1 * | 8/2011 | Chen | A45F 3/24 5/120 |
| 8,656,532 | B2 * | 2/2014 | Lee | B23K 9/0026 5/120 |
| 10,455,942 | B2 | 10/2019 | Chen et al. | |
| 11,330,893 | B2 * | 5/2022 | Goodwin | A45F 3/26 |
| 11,350,755 | B2 * | 6/2022 | Hu | A47C 4/30 |
| 11,547,201 | B1 * | 1/2023 | Sun | A47C 3/026 |
| 12,419,422 | B2 * | 9/2025 | Zhang | A47C 4/286 |

(Continued)

FOREIGN PATENT DOCUMENTS

| | | | | |
|---|---|---|---|---|
| CN | 218999898 U | | 5/2023 | |
| CN | 221931613 U | * | 11/2024 | |
| CN | 119611190 A | * | 3/2025 | B60N 3/008 |

(Continued)

*Primary Examiner* — Timothy J Brindley

(74) *Attorney, Agent, or Firm* — Thompson Coburn LLP

(57) ABSTRACT

A suspension chair has a frame that includes a base and a riser supported by the base. A seat connecting part corresponds to the riser. The seating connecting part is adapted for connection to a seat of the suspension chair. A plug assembly structure is provided for the riser and the seat connecting part. The plug assembly structure has a first portion removably connectable to the riser at a distal end of the riser away from the base. The plug assembly structure has a second portion connected to the seat connecting part.

11 Claims, 3 Drawing Sheets

(56) References Cited

U.S. PATENT DOCUMENTS

| | | | | |
|---|---|---|---|---|
| 12,458,132 | B2 * | 11/2025 | Liu | A45F 3/24 |
| 2025/0248507 | A1 * | 8/2025 | Shen | A45F 3/24 |

FOREIGN PATENT DOCUMENTS

| | | | | |
|---|---|---|---|---|
| DE | 202021003187 | U1 * | 1/2023 | B60R 9/06 |
| JP | 3178725 | U * | 9/2012 | |
| KR | 102799271 | B1 * | 4/2025 | A47C 9/105 |

* cited by examiner

SUSPENSION CHAIR AND PLUG ASSEMBLY STRUCTURE

RELATED APPLICATION

This application claims priority benefit to Chinese utility model patent application serial no. CN 202322908266.3, filed Oct. 27, 2023, the disclosure of which is incorporated by reference herein.

TECHNICAL FIELD

The present utility model relates to the field of leisure furniture, and particularly to a suspension chair (camping chair) and a plug assembly structure therefor.

BACKGROUND ART

With improvement of living standards, people are interested in various outdoor camping or leisure sports, and more and more camping devices also emerge on the market. For convenience of carrying and flexibility of use, many camping devices are foldable, among which there are foldable bundle-type suspension chairs that meet users' needs to sit and lean on.

Existing foldable bundle-type suspension chairs stand by six-point support on the ground, and after being collapsed, a product volume is reduced, but a packaging height is close to a length of a support rod (vertical rod), and a packaging volume of the product can hardly be further reduced.

SUMMARY

In order to solve the above technical problem, the first objective of the present utility model is to provide a plug assembly structure of a suspension chair, which structure can further reduce a packaging height of products. The second objective of the present utility model is to provide a suspension chair.

In order to achieve the first objective, the present disclosure adopts the following technical solutions.

A plug assembly structure of a suspension chair is connectable to a seat connecting part. The plug assembly structure with the seat connecting part connected thereto may then be removably attachable to a suspension chair frame. The suspension chair frame includes at least two risers, and a respective plug assembly structure may be inserted into the top portion of the riser. The seat connecting part is mounted on top portions of the plug assembly structure and may be removably connected therewith or are integrally formed therewith.

As a preferable solution, the seat connecting part is sleeved over a top portion of the plug assembly structure.

As a preferable solution, the seat connecting part is provided with a through hole in a lower portion thereof, the plug assembly structure is provided with a through hole in an upper portion thereof. After the seat connecting part is sleeved over the plug assembly structure, the seat connecting part may be fixed to the corresponding plug assembly structure with a mechanical fastener (e.g., a rivet) extending through the respective through holes.

As a preferable solution, the plug assembly structure includes two integrally formed tubes with different external diameters.

As a preferable solution, the plug assembly structure includes a first tube and a second tube, wherein an external diameter of the first tube is greater than that of the second tube such that a stepped surface or shoulder is formed at a junction of the first tube and the second tube. Thus, after the plug assembly structure is inserted into the riser of the suspension chair frame, the stepped surface abuts against the top portion of the riser with the second tube inserted into the bore of the riser.

As a preferable solution, the external diameter of the first tube is the same as the external diameter of the riser, the external diameter of the second tube is slightly smaller than an internal diameter of the riser. Further, the second tube may formed of a flat-tube structure, and the top portion of the riser is provided with a bore having a cross section matching the flat-tube structure of the second tube. In this may, the orientation of the second tube relative to the riser may be keyed and prevent rotation.

As a preferable solution, a length direction of the flat-tube structure of the second tube and the matching cross-section of the bore of the riser is parallel to a left-right direction of the suspension chair.

As a preferable solution, the stepped surface or shoulder of the plug assembly structure is provided with a protective ring, the top portion of the riser is also provided with a sheath, and after the plug assembly structure is inserted into the riser, the protective ring and the sheath abut against each other.

In a second aspect of the disclosure, a suspension chair is provided with a plug assembly structure which may be as described above.

Accordingly, the suspension chair includes a seat and the plug assembly structure according to any one of the above, wherein a length of the plug assembly structure is less than a length of the riser.

As a preferable solution, the suspension chair includes a suspension chair soft, e.g., pliable seat, wherein the suspension chair pliable seat is connected to left and right seat connecting parts, and the suspension chair pliable seat is at least partially located between the left and right risers. The risers are each provided with a sliding part, and are further provided with a bottom connecting part at a bottom portion thereof. The two risers are connected to each other by cross tube assemblies which are respectively hinged with the sliding parts and the bottom connecting parts, and the risers are each provided with a diagonal supporting assembly respectively on front and rear sides thereof.

Compared with the prior art, the present utility model has the following beneficial effects: (a) in use with the suspension chair expanded, the plug assembly structure may be connected with the risers of the suspension chair frame, and the plug assembly structure may be fixed in position on the tops of the risers of the suspension chair frame to bring the effective height of the risers of the suspension chair frame to a proper distance for use; and (b) in collapsing or folding the suspension chair, for example, for storage, the lower ends of the plug assembly structure may be detached from the risers and may be conveniently removed, which reduces the effective height of the risers of the suspension chair frame, and further reduces the overall packaging height of the suspension chair.

BRIEF DESCRIPTION OF DRAWINGS

The drawings are used for providing a further understanding of the present disclosure and constitute exemplary embodiments and applications of the disclosure. Therefore, the drawings and description that follows is intended to explain applications of the disclosure, but does not constitute limitations of applications.

Figure 1:
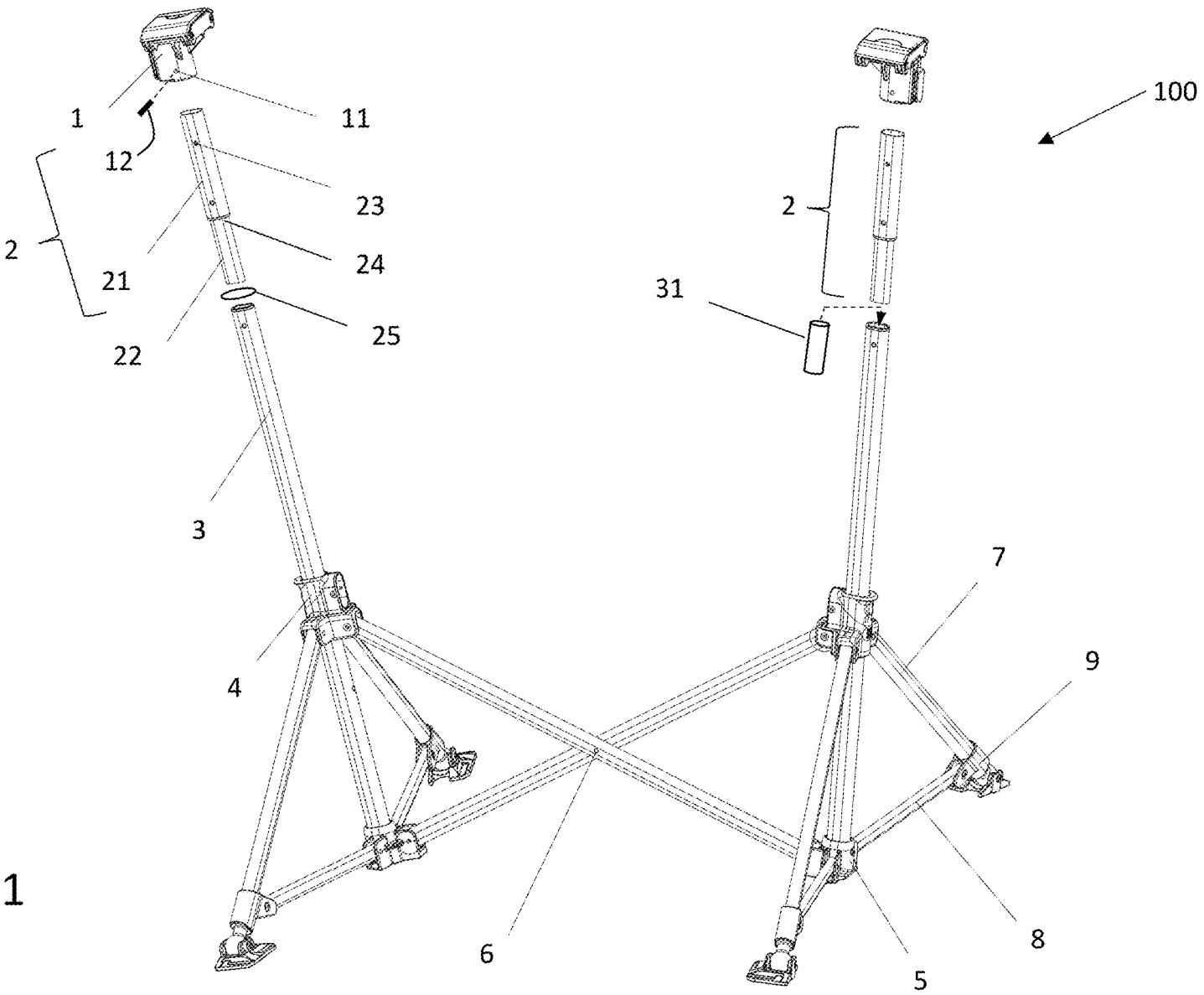
FIG. 1 is a structural schematic view of seat connecting parts, plug assembly structures and risers when being separated from each other.

The reference signs used correspond to the following elements: 1—seat connecting part; 11—through hole; 2—plug assembly structure; 21—first tube; 22—second tube; 23—through hole; 24—shoulder; 25—protective ring; 3—riser; 31—protective sheath; 4—sliding part; 5—bottom connecting part; 6—cross tube assembly; 7—diagonal supporting rod; 8—bottom supporting rod; 9—foot supporting block; 10—seat; and 100—suspension chair frame.

DETAILED DESCRIPTION OF EMBODIMENTS

It should be noted that the following detailed description is illustrative, aimed at further explaining the present application. Unless otherwise noted, all the technical and scientific terms used herein have the same meanings as commonly understood by those ordinarily skilled in the art to which the present disclosure belongs.

It should be noted that the terms used herein are only for the purpose of describing the embodiments, but are not intended to limit exemplary embodiments in accordance with the present disclosure. As used herein, the singular form is also intended to include the plural form as well, unless clearly indicated otherwise in the context. Besides, it also should be understood that when the terms "contain" and/or "include" are used in the present description, they indicate the presence of a feature, a step, an operation, a part, a component and/or a combination thereof.

In the description that follows, it should be understood that orientation or positional relationships indicated by the terms such as "center", "longitudinal", "transverse", "length", "width", "thickness", "up", "down", "front", "rear", "left", "right", "vertical", "horizontal", "top", "bottom", "inside", "clockwise", and "anticlockwise" are the orientation or positional relationships shown in the drawings, and these terms are only intended to facilitate describing the embodiments and simplifying the description, but not intended to indicate or imply that the referred devices or elements must be in a particular orientation, or constructed or operated in the particular orientation, and thus should not be construed as limitation to the embodiments.

The terms "first" and "second" are merely for descriptive purpose, but should not be construed as indicating or implying importance in relativity or implicitly indicating the number of a related technical feature. Thus, defining a feature with "first" or "second" may explicitly or implicitly mean that one or more such features are included. In the description that follows, unless otherwise specified, "a plurality of" means two or more.

In the present utility model, the terms such as "mount", "couple", "connect", and "fix" should be understood in a broad sense unless otherwise expressly specified and defined. For example, a connection may be a fixed connection, a detachable connection or an integral connection, may be a mechanical connection or an electric connection, or may be direct coupling, indirect coupling via an intermediary or internal communication between two elements. For those ordinarily skilled in the art, specific meanings of the above-mentioned terms in the description that follows could be understood according to specific circumstances.

In the present utility model, unless otherwise specified and defined explicitly, a first feature being "above" or "below" a second feature may include the first feature and the second feature being in direct contact, and also may include the first feature and the second feature being not in direct contact but being in contact through another feature therebetween. Moreover, the first feature being "on", "above" or "over" the second feature includes the first feature being right above or obliquely above the second feature, or merely means the horizontal height of the first feature being larger than that of the second feature. A first feature being "under", "below" or "underneath" a second feature includes the first feature being right below or obliquely below the second feature, or merely means that the horizontal height of the first feature being larger than that of the second feature.

The application of the disclosure is further described in conjunction with the drawings and embodiments.

Embodiment 1

Figure 2:
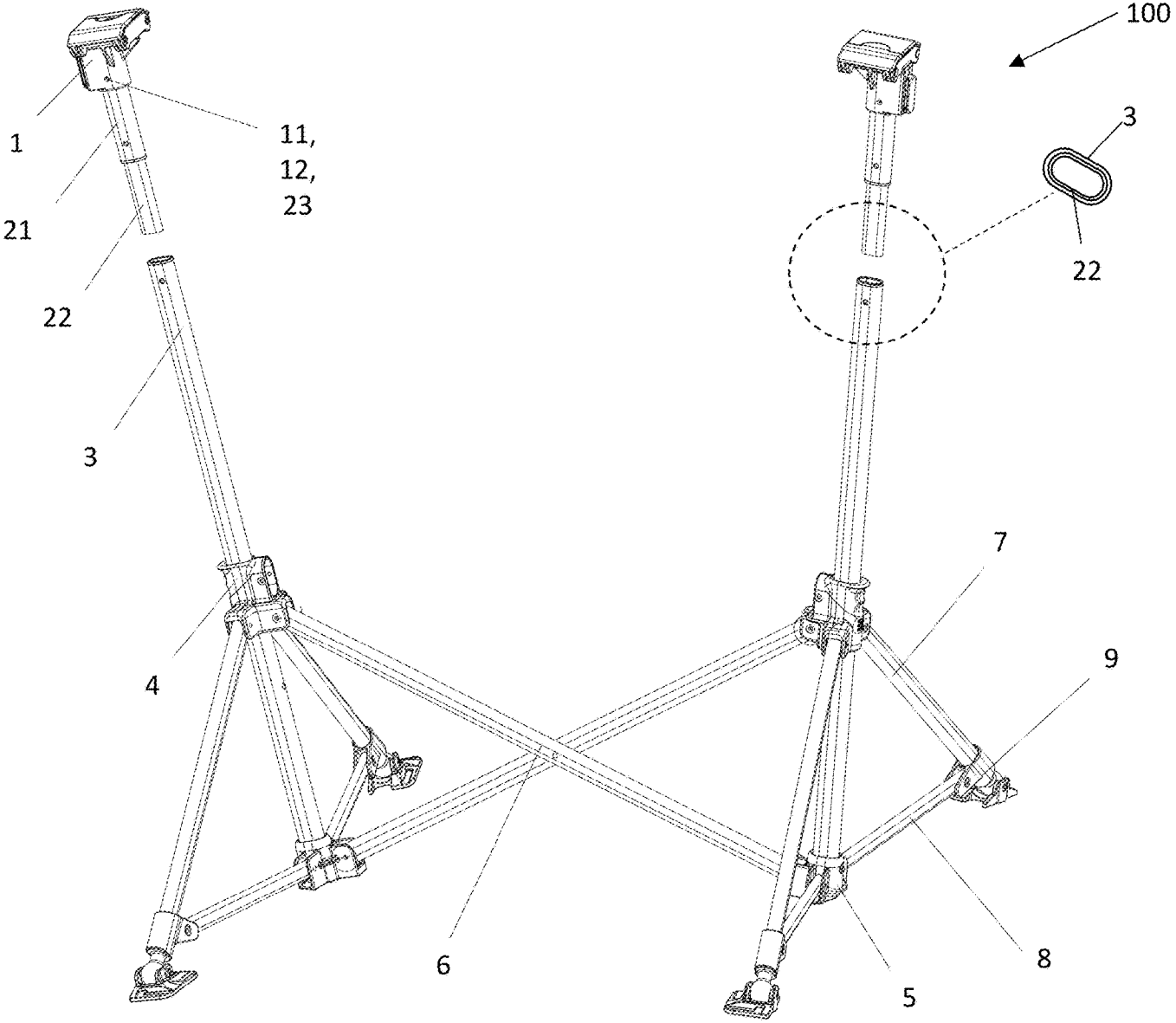
FIG. 2 is structural schematic view of an embodiment where the seat connecting parts and the plug assembly structures are fixed together with an inset showing the cross-sections of the riser and the plug assembly structure.
Figure 3:
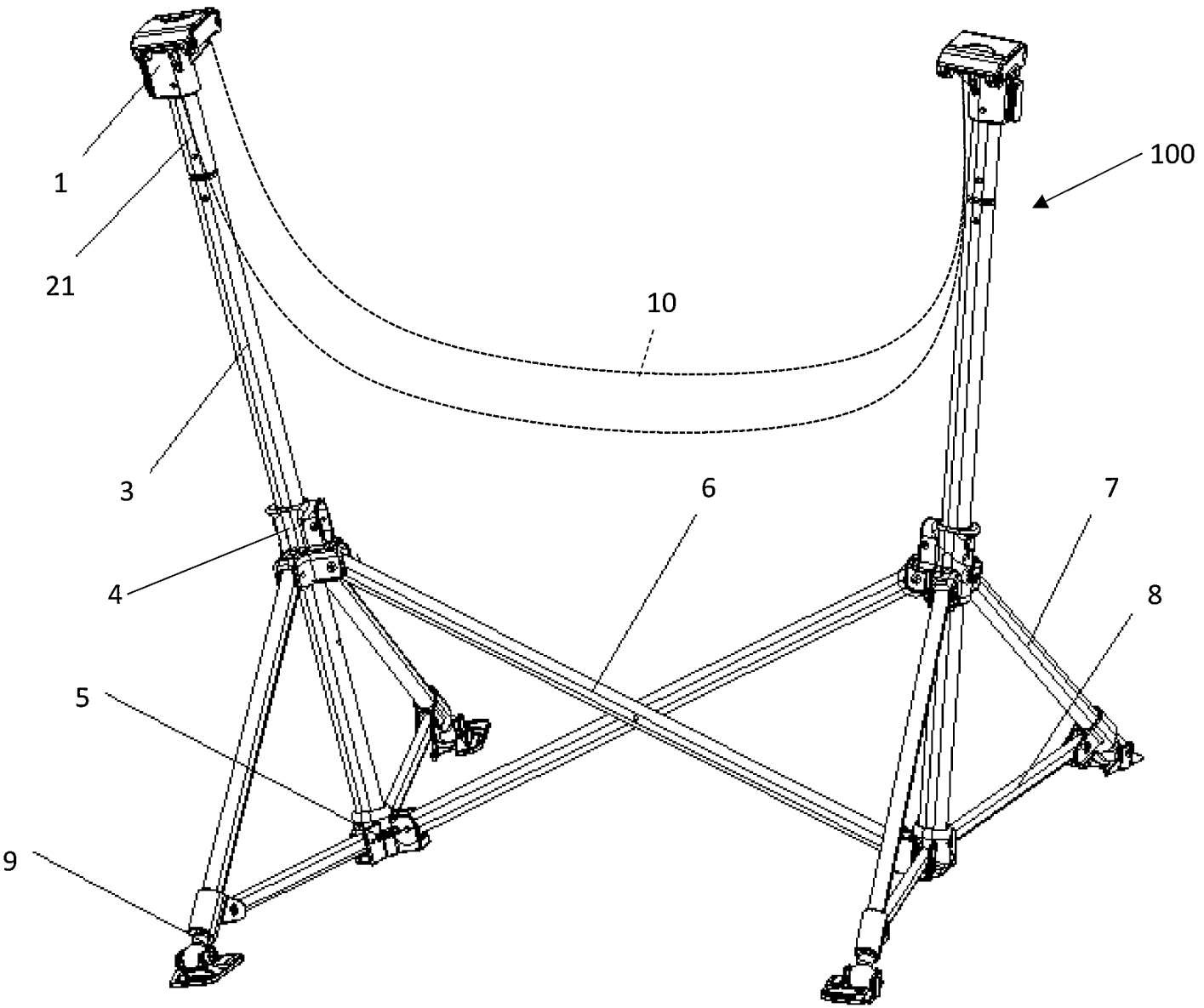
FIG. 3 is a structural schematic view of the seat connecting parts, the plug assembly structures are fully assembled with the risers, with a seat shown in phantom.

FIG. 1 to FIG. 3 show a suspension chair frame 100 and a plug assembly structure 2 of the suspension chair frame. The plug assembly structure 2 is connectable with a seat connecting part 1 that is connected to a pliable seat. The seat connecting part 1 is arranged at the top portion of the plug assembly structure 2. The seat connecting part 1 may be removably connected with the plug assembly structure 2 or may be permanently fixed with the plug assembly structure with a mechanical fastener 12.

The suspension chair frame 100 includes at least two risers 3. A plug assembly structure 2 is connectable with a distal end or top portion of a respective riser 3. As described below, the plug assembly structure 2 may be insertable into a bore of the riser 3 at the distal end of the riser. In the alternative, the plug assembly structure may be sleeved over the riser at the distal end of the riser. In use, the plug assembly structure 2 is connected to the risers in the suspension chair frame, and fixed in position on the risers of the suspension chair frame with the weight of the user sitting in the seat 10. The plug assembly structure 2 increases the effective height or length of the riser 3 in the suspension chair frame 100 to a distance as needed for use; and in collapsing the suspension chair frame 100, a lower end of the plug assembly structure 2 may be detached from the riser 3 and can be conveniently removed, which reduces the effective height of the risers of the suspension chair frame, and further reduces the size of the suspension chair frame for storage, and the overall package size of the product, for instance, for transportation, shipping, and retail shelf space.

In the embodiment shown in the drawings, the plug assembly structure 2 includes two integrally formed tubes 21,22 with different external diameters. One aspect of a specific structure is as follows: the plug assembly structure 2 includes a first tube 21 and a second tube 22. The external diameter of the first tube 21 is greater than that of the second tube 22, and a stepped surface or shoulder 24 is formed at a junction of the first tube 21 and the second tube 22. After the plug assembly structure 2 is inserted into the riser 3, the stepped surface 24 abuts against the top portion of the riser 3. The lower end of the plug assembly structure 2, for instance, the second tube 22, is insertable into a bore of the riser 3 and cooperates with the bore of the riser to constitute an integral body. The lower end of the plug assembly structure 2, for instance, the second tube 22, may be shaped relative to the bore of the riser 3 so that the connection therebetween becomes tighter when in use. The inset of FIG. 2 shows one embodiment of a matching shape.

The external diameter of the first tube 21 may be the same as the external diameter of the riser 3 so as to provide a seamless appearance. The external diameter of the second tube 22 may be slightly smaller than an internal diameter of the riser 3 so as to allow a slip fit when the second tube 22 is inserted into the bore of the riser. As shown in the inset of FIG. 2, the second tube 22 may have a flat-tube structure, and the top portion of the riser 3 may be provided with a cooperating matching geometric cross section (e.g., a waist tube) that matches the shape of the external surface of the second the tube 22. A length direction of the matching geometric cross-sections of the external surface of the second tube 22 and the bore of the riser 3 (e.g., the long, flat portion of the tube cross-sections) may be parallel to the front and back direction of the suspension chair frame 100. In this way, the arrangement of the second tube 22 with the riser 3 may be keyed or interlockable, which serves to prevent rotation of the plug assembly structure 2 with the riser 3, which is conducive to improving stability of the suspension chair. In addition to the matching flat tube cross-sectional geometry, the matching cross-sectional geometry or keyed arrangement may be of another type having the same anti-rotation effect, for example, a polygonal hole such as triangular or rectangular hole. Meanwhile, as the suspension chair pliable seat 10 is located between left and right risers, making the length direction of the flat-shaped bore of the riser 3 and long flat of the tube 22 parallel to the front and back direction of the suspension chair frame 100, which is conducive to improving bending strength of the plug assembly structure 2.

The stepped surface 24 of the plug assembly structure 2 may be provided with a protective ring 25, the top portion of the riser 3 may be provided with a sheath 31. After the plug assembly structure 2 is inserted into the riser 3, the protective ring 25 and the sheath 31 may abut against each other. The external diameter of the plug assembly structure 2 is consistent with the external diameter of the riser 3, so as to create a more coordinated and aesthetic appearance. Moreover, adding the protective ring 25 and the sheath 31 at a contact surface between the plug assembly structure 2 and the riser 3 can reduce wear after long-term use and prolong the service life of the product.

In other embodiments, the plug assembly structure 2 can also be a tapered tube with a large upper part and a small lower part, and an outer wall of a lower end of the tube structure of the plug assembly forms conical-surface fit with an inner wall or bore of the riser. The plug assembly structure 2 may also be sleeved over the riser 3.

The respective seat connecting part 1 may be sleeved over the top portions of the plug assembly structure 2. In order to further improve connection strength between the seat connecting parts 1 and the plug assembly structure 2, the seat connecting part 1 may be provided with a through hole 11 in a lower portion thereof. The plug assembly structure 2 may be provided with a through hole 23 in an upper portion thereof. For instance, as shown in the drawings the first tube 21 has the through hole 23. After the seat connecting part 1 is sleeved over the plug assembly structure 2, the seat connecting part 1 may be fixed to the plug assembly structure with a mechanical fastener (e.g., a rivet) 12 passing through the through holes 11,23. The seat connecting part 1 may also be removably connectable to the plug assembly structure 2 with a spring loaded pin arranged in the plug assembly structure 2 that extends through the through hole 11 of the seat connecting part, or a spring loaded pin arranged in lower portion of the seat connecting part 1 that extends through the through hole 23 of the plug assembly structure 2.

In disassembling and folding the suspension chair for storage, the lower ends of the plug assembly structure may be detached from the risers, and if applicable, the tube structure may be removed from the seat connecting part. Then the suspension chair frame may be collapsed together with the pliable seat. Then the pliable seat, the suspension chair frame and the plug assembly structure may be put into an storage bag together. As the effective length of the risers is reduced in size after removal of the plug assembly structures, the overall packaging height is reduced, further reducing an overall volume.

Embodiment 2

FIG. 3 shows the suspension chair frame 100 with the seat 10 in phantom and the plug assembly structure 2 as described earlier. A length of the plug assembly structure 2 is less than a length of the riser 3. When the suspension chair is in use, the pliable seat 10 is located between left and right risers, and left and right plug assembly structures 2 are subjected to an inwardly downward force. Because the length of the plug assembly structure is less than the length of the riser, the moment arm of force is reduced and amount of force applied to a portion where the plug assembly structure is inserted into the riser is reduced in comparison to the conventional suspension which does not utilize the plug assembly structure. This prolongs the service life of the suspension chair.

The pliable seat 10 that is connected to left and right seat connecting parts 1 may have straps that are buckled the left and right seat connecting parts to allow adjustment. In the alternative, the seat 10 may have loops with clips that are clipped to the left and right seat connecting parts. The connection of the seat to the seat connecting parts is conventional. The suspension chair pliable seat is at least partially located between the left and right risers 3, wherein the risers 3 are each provided with a sliding part 4, and are further provided with a bottom connecting part 5 at a bottom portion or proximal end of the risers 3. The two risers are connected to each other by cross tube assemblies 6 which are respectively hinged with the sliding parts 4 and the bottom connecting parts 5. The risers 3 are each provided with a diagonal supporting assembly respectively on front and rear sides thereof.

The diagonal supporting assembly includes a diagonal supporting rod 7, a bottom supporting rod 8 and a foot supporting block 9, wherein one end of the diagonal supporting rod 7 is hinged with the sliding part 4, one end of the bottom supporting rod 8 is hinged with the bottom connecting part 5, and the other ends of the bottom supporting rod 8 and the diagonal supporting rod 7 are connected to the foot supporting block 9.

Although the embodiments of the present utility model have been shown and described in the above, it can be understood that the above embodiments are exemplary and shall not be construed as limitation to the present utility model. Those of ordinary skill in the art could make changes, amendments, substitutions and variations to the above embodiments within the scope of the present utility model without departing from the principle and purposes of the present utility model. Any simple amendments, equivalent changes and modifications made to the above embodiments according to the technical essence of the present utility model still fall within the scope of the technical solutions of the present utility model.

What is claimed is:

1. A suspension chair comprising:

a frame comprising a base and a riser supported by the base;

a seat connecting part corresponding to the riser, the seating connecting part being adapted for connection to a seat of the suspension chair; and a plug assembly structure for the riser and the seat connecting part, the plug assembly structure having a first tube and a second tube, the first and second tubes being coaxially aligned with each other, the first and second tubes being coaxially aligned with the riser along an entire length of the riser when the plug assembly structure is removably connectable to the riser at a distal end of the riser away from the base, the first tube being connected to the seat connecting part, the plug assembly structure having a shoulder extending between the first tube and the second tube, the shoulder abutting the distal end of the riser when the second tube is inserted in a bore of the riser at the distal end of the riser so as to removably connect the plug assembly to the distal end of the riser without a mechanical fastener when the seat is weighted and the suspension chair is in use.

2. The suspension chair according to claim 1, wherein the seat connecting part is sleeved over the second portion of the plug assembly structure.

3. The suspension chair according to claim 2, wherein the seat connecting part is provided with a through hole in a lower portion thereof, the second portion of the plug assembly structure is provided with a through hole in an upper region thereof.

4. The suspension chair according to claim 3, wherein the seat connecting part is connected with the plug assembly structure with a mechanical fastener.

5. The suspension chair according to claim 1, wherein an external diameter of the first tube is greater than that of the second tube.

6. The suspension chair according to claim 5, wherein the external diameter of the first tube is the same as an external diameter of the riser.

7. The suspension chair according to claim 1, wherein the second tube has a flat-tube cross-section that matches the bore of the riser at the distal end of the riser.

8. The suspension chair according to claim 1, wherein the second tube has a cross-section that cooperates with the bore of the riser at the distal end of the riser to prevent rotation of the second tube within the bore of the riser when the second tube is inserted in the bore of the riser.

9. The suspension chair according to claim 1, wherein the shoulder of the plug assembly structure is provided with a protective ring, the distal end of the riser is provided with a sheath, the protective ring and the sheath abut against each other when the plug assembly structure is assembled with the riser.

10. The suspension chair according to claim 1, wherein the seat connecting part is removable connected to the first tube of the plug assembly structure.

11. The suspension chair according to claim 1, wherein the riser is one of two risers extending from the base, each riser has a slider configured for sliding on the riser and a bottom connecting part at proximal end of the riser, the two risers are connected to each other by cross tubes that are respectively hinged with the sliders and the bottom connecting parts, and each of the risers are each provided with a diagonal supporting assemblies arranged orthogonal to the cross tubes.

* * * * *